US006690900B2

(12) United States Patent
Dougherty et al.

(10) Patent No.: US 6,690,900 B2
(45) Date of Patent: Feb. 10, 2004

(54) METHOD OF AND SYSTEM FOR THE REDUCTION OF TONER PRESSURE APPLIED TO A PRINT SEAL THROUGH THE IMPLEMENTATION OF A TAPERING CHANNEL

(75) Inventors: Patrick S. Dougherty, Boise, ID (US); Quintin T. Phillips, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/103,208

(22) Filed: Mar. 21, 2002

(65) Prior Publication Data

US 2003/0180066 A1 Sep. 25, 2003

(51) Int. Cl.[7] ..... G03G 15/08
(52) U.S. Cl. ..... 399/103
(58) Field of Search ..... 399/162, 103, 399/105

(56) References Cited

U.S. PATENT DOCUMENTS 5,757,395 A 5/1998 Chew et al. ..... 347/24
5,760,817 A 6/1998 Foote et al. ..... 347/248
5,854,961 A 12/1998 Wibbels et al. ..... 399/281
6,487,383 B2 * 11/2002 Buchanan et al. ..... 399/103

OTHER PUBLICATIONS

"Oasis–Tech's Tool Box–Laser Printing Process" [on–line] [Retrieved on Nov. 26, 2001]Retrieved from: http://www.oasis–imaging.com/tech/related.html, pp. 1–4.
"The PC Technology Guide–Laser Printers" [on–line] [Retrieved on Nov. 26, 2001] Retrieved from: http:// www-.pctechguide.com/12lasers.htm, pp. 1–8.

* cited by examiner

*Primary Examiner*—William J. Royer

(57) ABSTRACT

The present invention includes a toner cartridge having a developer roller having a cylindrical exterior surface with a tapering ramped channel formed in the surface of at least one end of the developer roller. The tapering ramped channel having a narrow proximal end nearest the at least one end of the developer roller and a wide distal end furthest from the at least one end of the developer roller. The narrow proximal end of the tapering ramped channel extends deeper into the surface of the developer roller than the wide distal end. The tapering ramped channel functions to propel toner particles or other fluid accumulating against an end seal away from the seal, toward a central portion of the developer roller.

19 Claims, 2 Drawing Sheets

METHOD OF AND SYSTEM FOR THE REDUCTION OF TONER PRESSURE APPLIED TO A PRINT SEAL THROUGH THE IMPLEMENTATION OF A TAPERING CHANNEL

RELATED APPLICATIONS

The present application is related to commonly assigned U.S. patent application Ser. No. 10/103,208 entitled "A SYSTEM FOR AND METHOD OF REDUCING TONER SEAL LEAKAGE BY THE INTRODUCTION OF A STEP GROOVE IN THE DEVELOPER ROLLER" filed concurrently; U.S. patent application Ser. No. 10/103,430 entitled "SYSTEM FOR AND METHOD OF PREVENTING TONER LEAKAGE PAST DEVELOPER SEALS USING STATIC CHARGE" filed concurrently; U.S. patent application Ser. No. 10/103,371 entitled "SYSTEM FOR AND METHOD OF REDUCING OR ELIMINATING TONER LEAKAGE WITH A VIBRATING SEAL" filed concurrently; and U.S. patent application Ser. No. 10/103,451 entitled "SYSTEM FOR AND METHOD OF TONER FLOW CONTROL" filed concurrently the disclosures of which are hereby incorporated herein by reference in their entirety.

TECHNICAL FIELD

The present invention generally relates to electrophotographic printing devices and more specifically to the reduction of toner leakage through seals in these devices.

BACKGROUND

Currently there are several types of technologies used in printing and copying systems. Electrophotographic printing devices such as laser printers and copiers use toner particles to form the desired image on the print medium, which is usually some type of paper. While the toner particles are solid, their small size (on the order of 3–15 microns) results in highly fluid properties. Once the toner is applied to the paper, the paper is advanced along a paper path to a fuser. In many printers, copiers and other electrophotographic printing devices, the fuser includes a heated fusing roller engaged by a mating pressure roller. As the paper passes between the rollers, toner is fused to the paper through a process of heat and pressure.

FIG. 7 is a diagram of typical laser printing device 700 employing an ElectroPhotography (EP) process. For monochromatic printing, a single color of toner particles 701 are held in toner supply hopper 702. Toner particles 701 are typically small plastic (e.g. styrene) particles on the order of 5 microns ($10^{-6}$) meter in size. Agitator, or stirring blade, 703 is typically made of plastic or mylar and ensures toner particles 701 are uniformly positioned along developer sleeve 704 while inducing a negative charge onto the toner particles 701 in the range of −30 to −40 microcoulomb per gram ($\mu$c/g). Developer sleeve 704 rotates in a counterclockwise direction about an internal stationary magnet 705 which acts as a shaft. Toner particles 701 are attracted to the rotating developer sleeve 704 by the magnetic forces of stationary magnet 705. Doctor blade 706 helps in charging toner particles 701 and metes out a precise and uniform amount of toner particles 701 onto developer sleeve 704 as its outer surface rotates external to toner supply hopper 702. Developer sealing blade 707 allows excess toner particles 701 affixed to developer sleeve 704 to be returned to toner supply hopper 702 without leakage.

Primary Charging Roller (PCR) 708 conditions Organic PhotoConductor (OPC) drum 709 using a constant flow of current to produce a blanket of uniform negative charge on the surface of OPC drum 709. Production of the uniform charge by PCR 708 also has the effect of erasing residual charges left from the previous cycle.

A major component of the EP process is OPC drum 709. OPC drum 709 is a thin-walled aluminum cylinder coated with a photoconductive layer. The photoconductive layer may constitute a photodiode that accepts and holds a charge from PRC 708. Initially, the unexposed surface potential of the OPC drum 709 is approximately −600 volts. Typically, the photoconductive layer comprises three layers including, from the outermost inward, a Charge Transport Layer (CTL), Charge Generation Layer (CGL), and barrier or oxidizing layer formed on the underlying aluminum substrate. The CTL is a clear layer approximately 20 microns thick, which allows light to pass through to the CGL and controls charge acceptance to the OPC drum 709. The CGL is about 0.1 to 1 micron thick and allows the flow of ions. The barrier layer bonds the photoconductive layer to the aluminum substrate.

Laser beam 710 exposes OPC drum 709 one line at a time at the precise locations that will receive toner particles 701 (paper locations which correspond to the image being printed). OPC drum 709 is discharged from −600V to approximately −100V at points of exposure to laser beam 710, creating a relatively positively charged latent image on its surface. Transformation of the latent image into a developed image begins when toner particles 701 are magnetically attracted to rotating developer sleeve 704. Alternatively, if nonmagnetic toner particles 701 are used, developer sleeve 704 may comprise a foam roller to mechanically capture toner particles 701. In this case, an open cell foam roller may be included to apply toner particles 701 to developer sleeve 704. The still negatively charged toner held by developer sleeve 704 is attracted to the relatively positively charged areas of the surface of OPC drum 709 and "jumps" across a small gap to the positively charged latent image on OPC drum 709 creating a developed image.

Paper to receive toner from OPC drum 709 is transported along paper path 711 between OPC drum 709 and transfer roller 712, with the developed image transferred from the surface of OPC drum 709 to the paper. The transfer occurs by action of transfer roller 712 which applies a positive charge to the underside of the paper, attracting the negatively-charged toner particles to move to the paper. Wiper blade 713 cleans the surface of the OPC drum 709 by scraping off the (untransferred or waste) toner particles 701 into waste hopper 715, while recovery blade 714 prevents the waste toner particles from falling back onto the paper. Fusing occurs as the paper, including toner particles, is passed through a nip region between heated roller 716 and pressure roller 717 where the toner particles 701 are melted and fused (or "bonded") to the paper. Heated roller 716 and pressure roller 717 are together referred to as the fuser assembly.

One design consideration with imaging devices such as laser printers and copying systems is to minimize the leakage of toner or toner particles 701 from the toner supply hopper 702. As shown in FIG. 8, in its normal position, developer sleeve 704 has a toner supply on one side of seal 801 and the atmosphere on the other side of seal 801. Seals in this area are incorporated in an attempt to reduce or eliminate toner leakage.

Leakage sometimes occurs along a roller and at the ends of developer sleeve 704. Several methodologies have been used to reduce or eliminate such leakage. For example, some printers employ a foam or felt mechanical seal at the ends of developer sleeve 704 as a physical barrier to prevent toner particles 701 from leaking past the end of developer sleeve 704 and out of toner supply hopper 702. Alternatively, when the toner includes magnetic particles, such as in some black and white printers, magnetic seals may be provided at the ends of developer sleeve 704 to attract and capture toner particles 701 and to create a physical barrier, consisting of the toner particles 701, to prevent additional particles from leaking.

FIG. 8 shows the configuration of developer sleeve 704, toner particles 701 and seal 801. As shown, seal 801 is positioned between support 802 and developer sleeve 704. As developer sleeve 704 rotates, toner particles 701 are forced into junction 803 of seal 801 and developer sleeve 704. This action causes a buildup of toner and corresponding fluid pressure at junction 803 causing toner particles 701 to leak under, around and through seal 801.

Accordingly, a need exists for a system and a method for reducing toner leakage in a toner cartridge.

SUMMARY OF THE INVENTION

The present invention is directed to a system and method which comprises a toner cartridge including a developer roller having a cylindrical exterior surface with one or more peripheral tapering channels formed in the surface at one end of the developer roller. The channel has a narrow proximal end nearest the nearest end of the developer roller and a wide distal end toward the middle of the developer roller. The narrow proximal end of the channel extends deeper into the surface of the developer roller than does the wide distal end.

DETAILED DESCRIPTION

Figure 1:
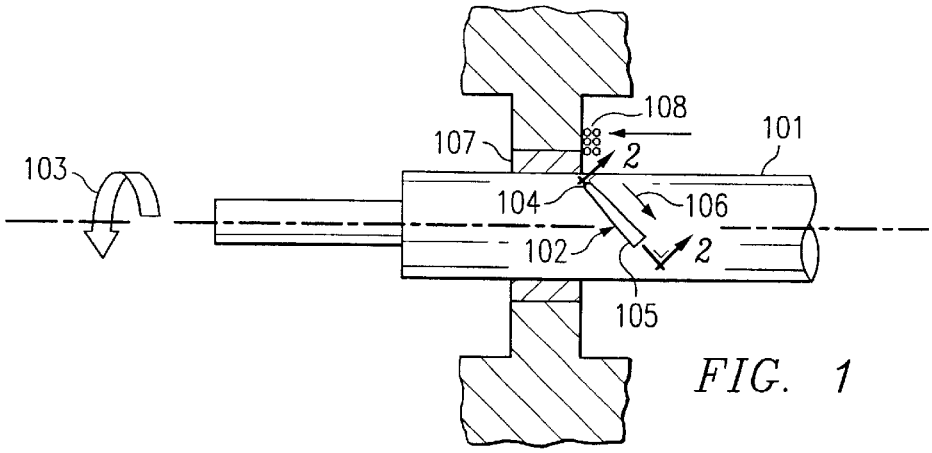
FIG. 1 is a frontal view of a left portion of a developer roller according to an embodiment of the present invention including a toner collection channel.

FIG. 1 shows developer roller 101 with an improved tapering channel feature that is designed to reduce the fluid pressure on seal 107 by directing the flow of toner particles 108 away from the junction between developer roller 101 and seal 107. The fluid pressure resulting from toner buildup near seal 107 is reduced as a result of the relative rotation of developer roller 101 and tapering ramped channel 102 with respect to stationary seal 107. The geometry and orientation of tapering ramped channel 102 relative to developer roller 101 depends on the rotational speed of developer roller 101 and the size of toner particles 108. Preferably, the tapering ramped channel 102 feature is machined into the surface of developer roller 101 so that the toner particles 701 are moved, by the geometry of the tapering ramped channel 102, away from the seal 107. Multiple tapering ramped channels 102 may be included in developer roller 101. Tapering ramped channels 102 are spaced circumferencely around the diameter so that the toner particles 701 are continually scooped or paddled away from seal 107 much as performed by an auger. Tapering ramped channels 102 are preferably incorporated on both ends of developer roller 101 to reduce or eliminate toner leakage at both seals 107.

Developer roller 101 rotates in a direction indicated by arrow 103. Tapering ramped channel 102 has a narrow section 104 (or proximal end) near to seal 107 and a wider section 105 (wide distal end) toward the longitudinal center of developer roller 101.

Figure 2:
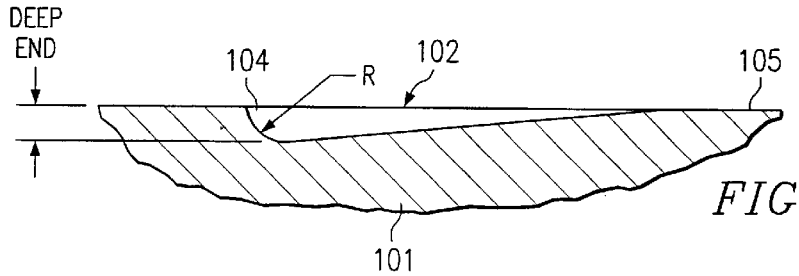
FIG. 2 is a cross sectional view of the tapering channel along lines 2—2 of FIG. 1.

FIG. 2 shows a cross section of tapering ramped channel 102 along cut line 2—2 (FIG. 1) which is generally formed as a tapered wedge or ramp cut into the surface of developer roller 101 at an arcuate angle. As can be seen from FIG. 2, narrow proximal end 104 of tapering ramped channel 102 extends deeper into developer roller 101 than wide distal end 105 of tapering ramped channel 102. The narrow, deeper portion of proximal end 104 of tapering ramped channel 102 ensures toner particles 108 are pushed or falls into the opening at narrow proximal end 104. The wider, shallower structure of distal end 105 of tapering ramped channel 102 ensures that the toner particles 108 that are pushed into narrow proximal end 104 are conveyed to wide distal end 105. This movement of toner particles 108 from narrow proximal end 104 to wide distal end 105 reduces toner-particle pressure on seal 107.

Tapering ramped channel 102 is also oriented in developer roller 101 so that narrow proximal end 104, closest to the seal 107, moves in under any toner particle buildup first, scooping out the toner particles 108 and pushing the toner particles 108 toward wide distal end 105 and the center of the developer roller 101. This orientation, and the shape of the tapering ramped channel 102 ensures toner travels from high pressure to low pressure, or away from seal 107. Reference arrow 106 indicates the direction of toner particles 108 flow in FIG. 1.

As described, the shape of tapering ramped channel 102 that is machined into the surface of developer roller 101 transitions from narrow and deep to wide and shallow. In other words, as shown in FIG. 2, narrow proximal end 104 extends deeper into developer roller 101 than wide distal end 105. The orientation encourages toner particles 108 to travel from a high pressure to a low pressure, in other words, away from seal 107. Toner particles 108 are being pushed away from seal 107 as developer roller 101 rotates in an "auger" type fashion. Thus, as developer roller 101 rotates, the tapering ramped channel or channels 102 generate a circular path of toner particles 108 on developer roller 101 at a point away from seal 107. The tapering ramped channels 102 transport the toner particles 108 from near the seal 107 back towards the center of the paper where the toner particles 108 are spread across the developer roller 101 onto the page by a doctor blade. Typically in a toner cartridge not incorporating the present invention, toner particles located near the seal never get developed onto a page because the toner particles 108 are outboard of the page.

Figure 3:
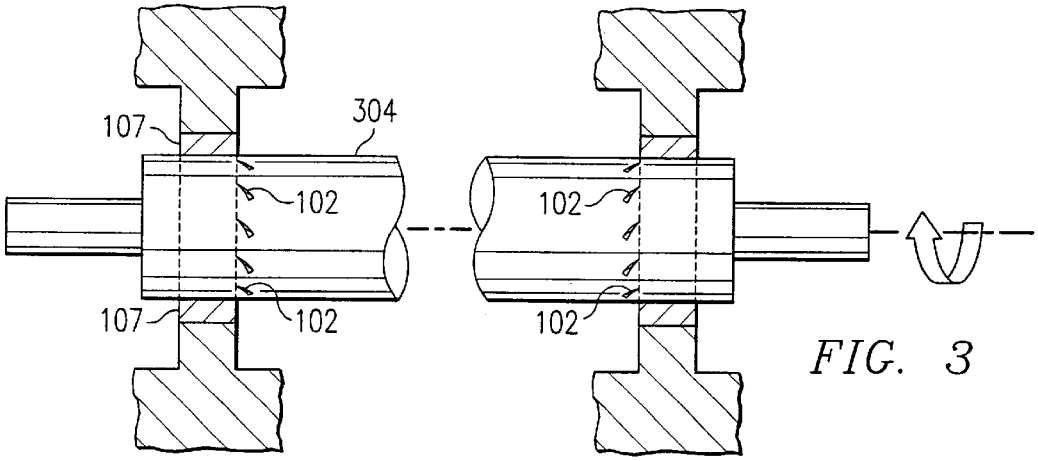
FIG. 3 is a front view of a developer roller incorporating a plurality of toner collection channels on opposing ends of the roller.

Further details of a developer roller 304 according to the invention can be seen in FIGS. 3 through 6. In particular, FIG. 3 is a front view of the developer roller 304 incorporating a plurality of toner collection channels or tapering ramped channels 102 on opposing ends of the developer roller 304. Tapering ramped channels 102 are formed in the surface of developer roller 304 at an arcuate angle relative to a longitudinal axis of the developer roller 304. For example, a projection of a centerline longitudinally bisecting tapering ramped channel 102 onto the longitudinal axis of developer roller 304 may form an angle of between 30 and 60 degrees and, more preferably, 45 degrees. Typically, for commonly used page-width developer rollers and for fluids such as printer toner, each tapering ramped channel 102 is between 1 and 5 mm long. A deep end of tapering ramped channel 102 proximate seal 107 extends between 0.1 and 1 mm down into the surface of the developer roller 304, gradually ramping up to the upper surface of the developer roller 304 at the end of the distal end of the tapering ramped channel 102 farthest from the seal 107. The tapering ramped channel 102 is narrowest at the proximal end nearest seal 107, widening toward the distal end to a final width of between 0.2 and 1 mm, the walls of the tapering ramped channel 102 forming an angle of between 5 and 20 degrees there between. The bottom of the tapering ramped channel 102 may have a rounded portion at the proximal end as shown in FIG. 2 with a radium R of between 2 and 10 mm so as to minimize any tendency for toner particles to get stuck between the sidewalls of the tapering ramped channel 102. The sidewalls may be straight or include a gradually tapering slope to avoid a sharp transition with the floor of the tapering ramped channel 102.

Figure 4:
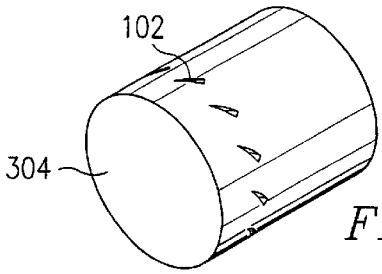
FIG. 4 is a perspective view of one end of a developer roller having formed therein a plurality of toner collection channels.
Figure 5:
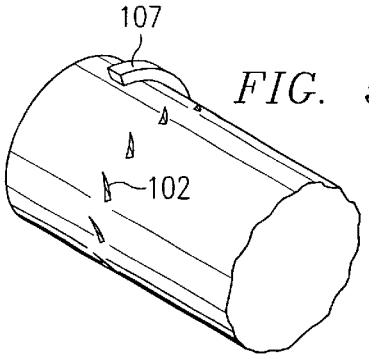
FIG. 5 is a perspective view of a developer roller according to the invention with toner collection channels formed proximate a roller end seal.
Figure 6:
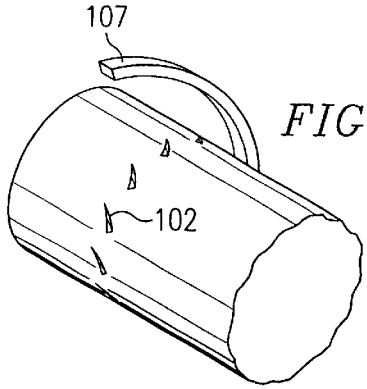
FIG. 6 is an exploded perspective view of the structure of FIG. 5.

Preferably, a plurality of tapering ramped channels 102 are arranged in annular rings at opposite ends of developer roller 304 immediately adjacent respective seals 107 as shown in FIG. 4. Seals 107 are better seen in FIGS. 5 and 6 as extending around a portion of developer roller 304 that is exposed to toner particles contained in a toner supply hopper. The number, size, geometry and relative placement of tapering ramped channels 102 may be optimized in view of the specific application including roller geometry, speed of rotation, fluid or particle properties (in this case, toner fluidity, size, and the like), operating temperature, among other things. For a conventional developer roller, it is expected that a single annular ring of between 10 and 50 tapering ramped channels would be provided at each end of the developer roller. However, other configurations may be used including, for example, multiple rings of tapering ramped channels and/or staggered positioning of tapering ramped channels.

Figure 7:
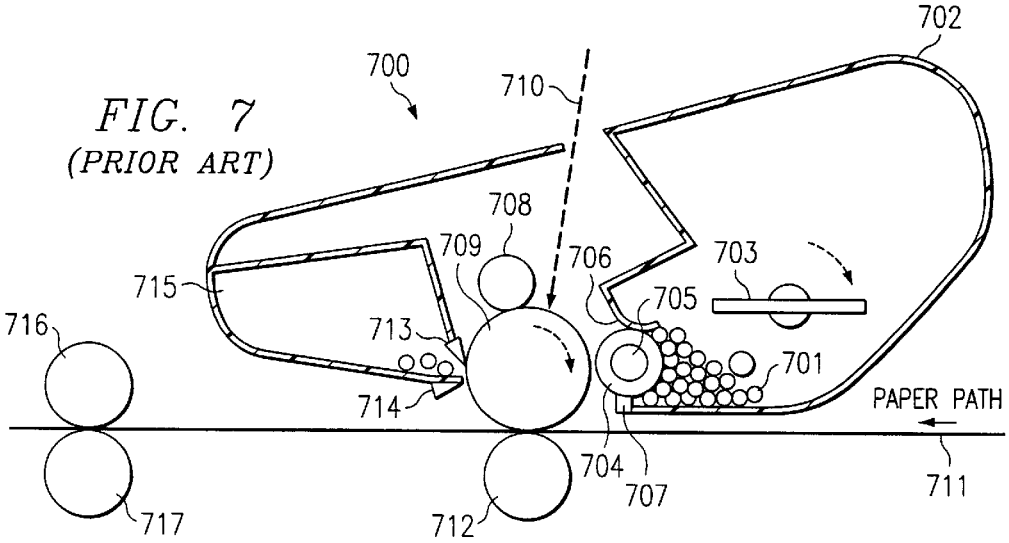
FIG. 7 (PRIOR ART)
FIG. 7 shows a prior art electrophotographic printing device.
Figure 8:
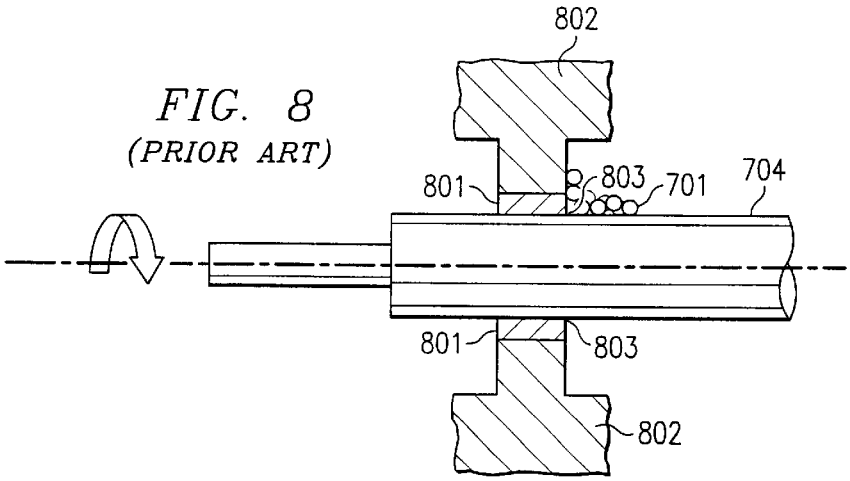
FIG. 8 (PRIOR ART)
FIG. 8 shows a configuration of a prior art developer roller, seal and support.

As shown in FIG. 7 as viewed from the left end of the developer sleeve 704, the surface of developer sleeve 704 rotates counterclockwise. Thus, a point on the surface of developer sleeve 704 would initially be positioned within toner supply hopper 702 for a portion of time, pass through doctor blade 706, be exposed to OPC drum 709, pass under developer sealing blade 707 and repeat this cycle. When the tapering ramped channel 102 of the current invention is incorporated into the circumference of developer roller 101 (FIG. 1) and located inboard of seal 107, the tapering ramped channel 102 travels into and out of toner hopper 702. When tapering ramped channel 102 passes through toner supply hopper 702, the action of the tapering ramped channel 102 causes toner particles 108 to flow away from seal 107. Toner particles 108 are also doctored by doctor blade 706 so that when the tapering ramped channel 102 is rotated such that it is on the exterior of the supply of toner particles 108 it would have a consistent thickness of toner particles 803 due to doctor blade 706 smoothing the toner particles 803, including the toner particles 803 recovered from against seal 107, as it goes by doctor blade 706.

What is claimed is:

1. A toner cartridge, comprising:

a developer roller having a cylindrical exterior surface with a tapering ramped channel formed in said cylindrical exterior surface near at least one end of the developer roller, said tapering ramped channel having a narrow proximal end nearest said at least one end of said developer roller and a wide distal end furthest from said at least one end of said developer roller, said narrow proximal end of said tapering ramped channel extending deeper into said cylindrical exterior surface than said wide distal end.

2. The toner cartridge according to claim 1 wherein a centerline of said tapering ramped channel forms an acute angle with a centerline of said developer roller.

3. The toner cartridge according to claim 1 further comprising:

an end seal having a contact surface positioned to engage a portion of said cylindrical exterior surface of said developer roller in a region immediately adjacent said tapering ramped channel.

4. The toner cartridge according to claim 1 wherein said developer roller further includes a plurality of tapering ramped channels radially spaced apart along a pair of annular ring regions at opposite ends of said developer roller.

5. The toner cartridge according to claim 4 further comprising:

a pair of end seals each having a contact surface positioned to engage a portion of said cylindrical exterior surface of said developer roller in a region immediately adjacent respective ones of said annular ring regions.

6. The toner cartridge according to claim 1 wherein said narrow proximal end of said tapering ramped channel has a bottom surface extending between 0.1 and 1 mm below said cylindrical exterior surface.

7. The toner cartridge according to claim 1 wherein said wide distal end of said tapering ramped channel is between 0.2 and 1 mm wide where a floor of said tapering ramped channel meets said cylindrical exterior surface of said developer roller.

8. The toner cartridge according to claim 1 wherein a plurality of tapering ramped channels are arranged in annular regions adjacent opposing seal contact regions of said developer roller and are configured so as to propel a fluid away from said seal contact regions toward a central portion of said developer roller.

9. The toner cartridge according to claim 1 further comprising:

a housing;

a development unit including a toner supply hopper, a said developer roller, and having at least one said tapering ramped channel at opposite ends of said developer roller and configured to reposition a flow of toner contained in said toner supply hopper from seeping out past said opposite ends of said developer roller, said developer roller having said cylindrical exterior surface;

a cleaning unit including a waste hopper, a wiper blade, a cleaning blade and a blow-out blade;

a primary charge roller;

a transfer roller; and an organic photoconductor.

10. The toner cartridge according to claim 9 wherein a plurality of said tapering ramped channels are arranged in annular regions adjacent opposing seal contact regions of said developer roller and are configured so as to propel a fluid away from said seal contact regions toward a central portion of said developer roller.

11. The toner cartridge according to claim 9 wherein said cylindrical exterior surface is made of a metal including one of aluminum and stainless steel.

12. The toner cartridge according to claim 9 wherein a central portion of said cylindrical exterior surface is uniformly smooth.

13. A toner cartridge, comprising:

a developer roller having a cylindrical exterior surface with opposing ends and a plurality of tapering channels formed in said surface proximate each of said opposing ends, said channels having a narrow proximal end closest to a nearest one of said ends and a wide distal end furthest from said nearest end, said narrow proximal end of said channels extending deeper into said surface than said wide distal end.

14. A roller for applying a fluid to a target structure, said roller comprising:

a cylindrical outer surface; and a plurality of tapering ramped channels formed in annular regions of said cylindrical outer surface proximate respective opposite ends of said cylindrical outer surface, said plurality of tapering ramped channels configured to propel a portion of said fluid coming into contact with said annular regions toward a central portion of said cylindrical outer surface away from respective ones of said annular regions.

15. The roller according to claim 14 wherein each of said plurality of tapering ramped channels has a deep, narrow end and a shallow, wide end rising up and merging with an upper surface of said cylindrical outer surface, a midline of each of said plurality of tampering ramped channels forming an angle of between 30 and 60 degrees with an axis of rotation of said roller.

16. The roller according to claim 14 wherein said deep narrow ends of said plurality of tapering ramped channels have a bottom surface extending between 0.1 and 1 mm into said roller.

17. The roller according to claim 14 wherein said shallow wide ends of said plurality of tapering ramped channels are each between 0.2 and 1 mm wide.

18. The roller according to claim 14 wherein said cylindrical outer surface is made of a metal selected from the group consisting of:

metal, aluminum and stainless steel.

19. The roller according to claim 14 wherein said plurality of tapering ramped channels have a curved cross-section adapted to avoid acutely angular intersections between walls and a bottom surface of said plurality of tapering ramped channels.

* * * * *

UNITED STATES PATENT AND TRADEMARK OFFICE

CERTIFICATE OF CORRECTION

PATENT NO. : 6,690,900 B2
DATED : February 10, 2004
INVENTOR(S) : Dougherty et al.

It is certified that error appears in the above-identified patent and that said Letters Patent is hereby corrected as shown below:

Column 6,
Line 52, delete “a said” and insert therefor -- said --.

Signed and Sealed this

Fifteenth Day of February, 2005

JON W. DUDAS
*Director of the United States Patent and Trademark Office*